US007927158B2

(12) United States Patent
Kim et al.

(10) Patent No.: US 7,927,158 B2
(45) Date of Patent: Apr. 19, 2011

(54) CONTACT TERMINAL FOR ELECTRONIC DEVICE

(75) Inventors: Ho-Su Kim, Gyeongsangbuk-do (KR); Jeong-Mi Baek, Gyeongsangbuk-do (KR)

(73) Assignee: Samsung Electronics Co., Ltd., Maetan-Dong, Yeongtong-Gu, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 12/608,448

(22) Filed: Oct. 29, 2009

(65) Prior Publication Data

US 2010/0136855 A1 Jun. 3, 2010

(30) Foreign Application Priority Data

Nov. 28, 2008 (KR) ..... 10-2008-119998

(51) Int. Cl.
*H01R 4/48* (2006.01)

(52) U.S. Cl. ..... 439/816

(58) Field of Classification Search ..... 439/816, 439/834–835, 828, 729, 836, 668
See application file for complete search history.

(56) References Cited

U.S. PATENT DOCUMENTS

| | | | | |
|---|---|---|---|---|
| 6,923,687 | B2 * | 8/2005 | Wang | 439/668 |
| 7,234,981 | B2 * | 6/2007 | Eppe et al. | 439/834 |
| 7,510,448 | B2 * | 3/2009 | Eppe et al. | 439/835 |
| 2008/0096441 | A1 * | 4/2008 | Eppe et al. | 439/816 |

* cited by examiner

*Primary Examiner* — Jean F Duverne
(74) *Attorney, Agent, or Firm* — Cha & Reiter, LLC

(57) ABSTRACT

A contact terminal of an electronic device includes: a fixing member; a contact member extending from the fixing member and a limiting member and extending from the fixing member where one end portion of the limiting member restrains one end portion of the contact member, wherein the contact terminal provides an elastic force upon the contact member in a direction away from the fixing member, and a range where the contact member moves away from the fixing member is limited since the end portion of the limiting member restrains the end portion of the contact member. The disclosed contact terminal can be directly mounted on a circuit board by using a surface mounting device (SMD) process, thereby reducing production costs and interconnection loss.

19 Claims, 5 Drawing Sheets

CONTACT TERMINAL FOR ELECTRONIC DEVICE

CLAIM OF PRIORITY

This application claims the benefit of the earlier filing date, pursuant to 35 USC 119, to that patent application entitled "Contact Terminal For Electronic Device" filed with the Korean Intellectual Property Office on Nov. 28, 2008 and assigned Serial No. 10-2008-0119998, the contents of which are incorporated herein by reference.

BACKGROUND OF THE INVENTION

1. Field of the Invention

The present invention relates to an electronic device, such as a cellular phone, a car navigation, and a computer, and more particularly to a contact terminal to be used for the connection of an additional device to an electronic device.

2. Description of the Related Art

An electronic device, such as a cellular phone, a car navigation, and a computer, is provided with various types of connectors for the connection of an additional device. For example, the connectors may be represent a USB (universal serial bus) connector that connects to a USB-capable memory device, or for the interconnection of electronic devices. Such connectors provide a communication line between an electronic device and at least one additional second device, or between electronic devices, thereby allowing the interchange of information generated from or stored in the electronic device.

A cellular phone or a notebook computer which is frequently seen around us, includes various types of connectors, especially in order to insure both portability and extensibility. Through such connectors, a user can extend the function of a portable electronic device by connecting additional devices to the portable electronic device.

Such a portable electronic device includes a battery pack, so that a user carrying the portable electronic device can use it when necessary. In general, a battery pack is provided to a portable electronic device in a removable manner to supply electrical power. Also, in the case of a cellular phone, when having a user identification module, called a SIM (Subscriber Identification Module) card, a user can make a call by using any cellular phone as long as the cellular phone allows SIM card connection without an additional subscription process.

Hereinafter, a component removably provided to a main body of a portable electronic device, such as a battery pack, a SIM card, etc., will be referred to as an 'additional device'.

An electronic device includes various types of connectors for connecting additional devices, and the connectors include various types of contact terminals for providing electrical contacts. Some components, such as a battery pack, may be provided in the main body of an electronic device while exposing contact terminals without an external connector shape.

Hereinafter, the configuration of a conventional contact terminal will be described, with reference to a contact terminal used for the connection of a battery pack provided to an electronic device s, such as a cellular phone.

Referring to FIGS. 1 to 3, a contact terminal 100 of an electronic device, according to an embodiment of a prior art, is provided wherein only a part of the contact terminal is exposed to the outside of the electronic device. Also, within the electronic device, the contact terminal is electrically connected to a socket 131 provided to a circuit board 103 through an additional connecting member 133.

The contact terminal 100 is fabricated by a cutting or casting (e.g. die casting) of a metallic plate, and includes a fixing member 101 and a contact member 113 which are formed to face each other. On the fixing member 101 and the contact member 113, connecting projections 115*a* and 115*b* are formed, respectively, and on the fixing member 101, coupling pieces 111, as a means for fixing the terminal in an electronic device, are formed.

From among the connecting projections, the first connecting projection 115*a*, which is a part of the contact member 113, curvedly extends away from the fixing member 101 while protrudes slightly upward, while the second connecting projection 115*b* is bent upward with a curvature and inclination from one end of the fixing member 101. The first connecting projection 115*a* contacts with terminals provided to the contact node of an additional device, and the second connecting projection 115*b* contacts with the connecting member 133 within the electronic device. Herein, the connections between the first connecting projection 115*a* and a power terminal 13 of the battery pack, and between the second connecting projection 115*b* and the connecting member 133, are maintained by an elastic force of the contact terminal 100 itself.

The coupling pieces 111, are formed at both side ends of the fixing member 101, and are formed with holes for connecting to other structures. As shown in FIG. 2, on the inside surface of an electronic device case 11, at both sides of an aperture exposing the first connecting projection 115*a*, protrusions (not shown) are formed. When the not shown protrusions pass through the holes of the connecting pieces 111 in the contact terminal 100, the shape of the protrusions is deformed into a rivet head by, for example, an ultrasonic fusion process or other similar process, thereby tightly adhering the connecting pieces 111 to the electronic device case 11.

In order to secure durability, the contact terminal 100 may include a supporting member 102. The supporting member 102, in one aspect, is made of an elastic body of silicon, urethane, or similar type material, and is disposed between the fixing member 101 and the contact member 113. The supporting member 102 may maintain the stable connection of the contact member 113 with the power terminal 13 of the battery pack, and may reduce the possibility of permanent deformation of the contact terminal 100 according to the accumulation of fatigue.

However, such a conventional contact terminal has a disadvantage in that its fabricated components are difficult to be assembled to a product. In other words, since besides a metallic fixing member and a metallic contact member, a supporting member made of an elastic body is required to be additionally provided, and, thus, an additional assembly process is required. Also, an ultrasonic fusion process, or similar type process, is required to attach the contact terminal on the inside surface of the electronic device. This reduces the productivity of manufacturing a product while increasing production costs.

Also, since a conventional contact terminal has no structure for preventing a contact member from being deformed when detaching from a fixing member, there is a problem in that the defect rate of products increases due to excessive protrusion of a connecting projection to the outside of the electronic device.

Furthermore, the conventional contact terminal requires intermediate components, such as the contact terminal, the connecting member, and the socket, from the battery pack to the circuit board, and thus due to the interconnection loss between respective components, the consumption of electrical power of the battery pack is increased.

SUMMARY OF THE INVENTION

Accordingly, the present invention provides a contact terminal, which can reduce the labor and cost required for fabricating electronic devices with a simply and less costly manufacture and assembly processes.

Also, the present invention provides a contact terminal, which can improve the defect rate of products by improving structural stability and reducing the possibility of deformation.

Further, the present invention provides a contact terminal, which can reduce the interconnection loss of components by reducing the number of intermediate components from an additional device to the circuit board.

In accordance with an aspect of the present invention, a contact terminal of an electronic device includes: a fixing member; a contact member extending from the fixing member, which moves while facing the fixing member; and a limiting member, which is bent and extends from the fixing member while an end portion of the limiting member restrains an end portion of the contact member, wherein the contact terminal provides an elastic force upon the contact member in a direction away from the fixing member, and a range where the contact member moves away from the fixing member is limited since the end portion of the limiting member restrains the end portion of the contact member.

In such a contact terminal, the contact member may further include a contact projection which protrudes and extends away from the fixing member.

Also, the contact terminal may further include a supporting member, which extends from the fixing member, and is disposed between the fixing member and the contact member, wherein the supporting member limits a range where the contact member comes close to the fixing member.

Herein, the supporting member has a 'U' shape, and a curved portion of the supporting member may selectively rub against one surface of the contact projection facing the fixing member.

Furthermore, preferably, the contact member further includes protecting members provided at both side ends of the contact projection, wherein the protecting members wrap at least one portion of the supporting member.

In the contact terminal provided with such protecting members, the supporting member has a 'U' shape, and a curved portion of the supporting member selectively rubs against one surface of the contact projection facing the fixing member and is wrapped by the protecting members.

In providing the contact terminal, the fixing member is mounted and fixed on a circuit board within the electronic device, and the contact projection protrudes to the outside of the electronic device.

Herein, when an additional device is mounted in the electronic device, the contact projection moves back into the electronic device as contact with the additional device of the electronic device is made and, thus, the contact member comes closer to the inside of the fixing member.

Such a contact terminal may further include a supporting member, which extends from the fixing member, and is disposed between the fixing member and the contact member, wherein as the contact member comes closer to the fixing member, the supporting member rubs against the contact member, thereby limiting a range where the contact member comes close to the fixing member.

Herein, the supporting member has a 'U' shape, and a curved portion of the supporting member selectively rubs against one surface of the contact projection facing the fixing member.

Herein, as mentioned above, an 'additional device' may be one of a battery pack, a SIM card, etc., as well as other types of peripheral devices.

BRIEF DESCRIPTION OF THE DRAWINGS

The above and other exemplary features, aspects, and advantages of the present invention will be more apparent from the following detailed description taken in conjunction with the accompanying drawings, in which.

DETAILED DESCRIPTION OF THE INVENTION

Exemplary embodiments of the present invention will be described in detail with reference to the accompanying drawings. For the purposes of clarity and simplicity, a detailed description of known functions and configurations incorporated herein is omitted to avoid making the subject matter of the present invention unclear.

Figure 1:
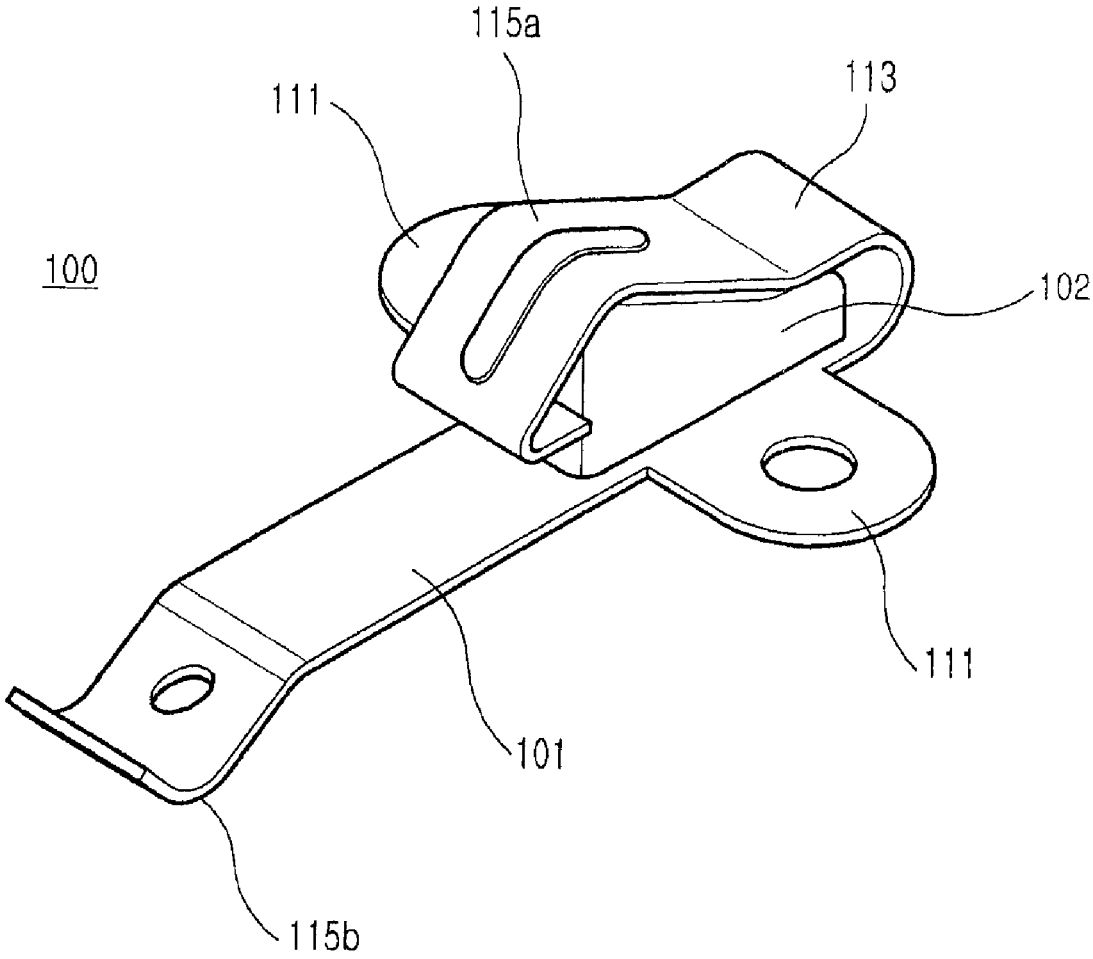
FIG. 1 (PRIOR ART)
FIG. 1 is a perspective view illustrating a contact terminal of an electronic device, according to an embodiment of a prior art.
Figure 2:
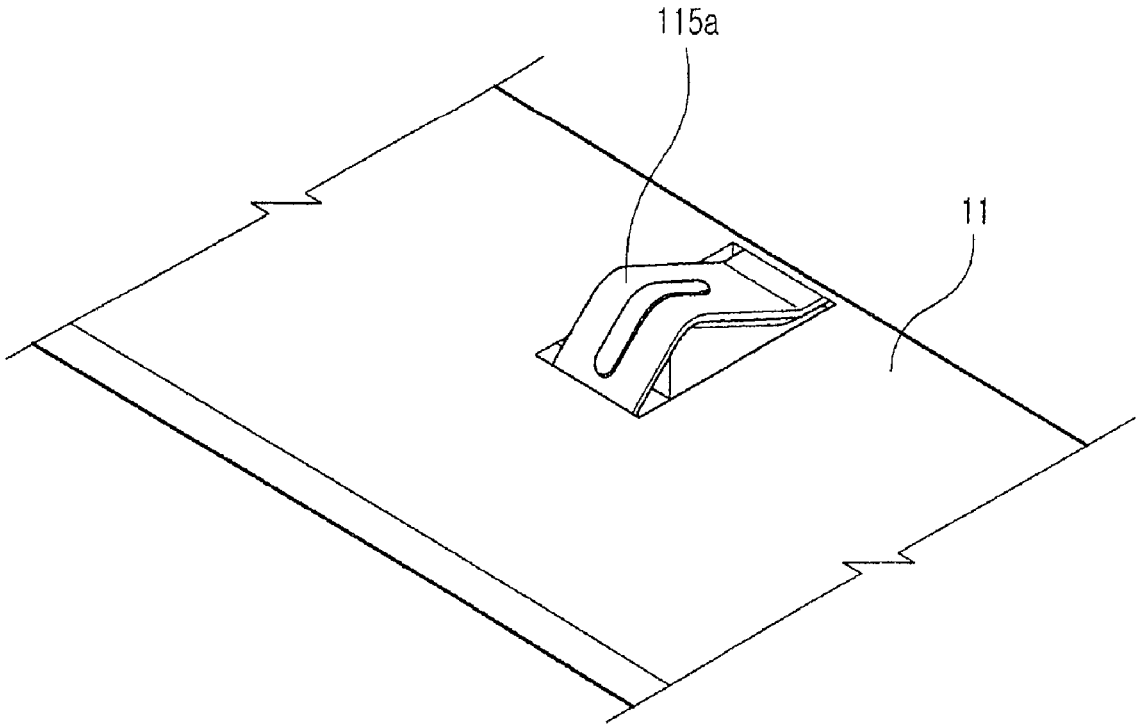
FIG.2 (PRIOR ART)
FIG. 2 is a perspective illustrating the contact terminal as shown in FIG. 1.
Figure 3:
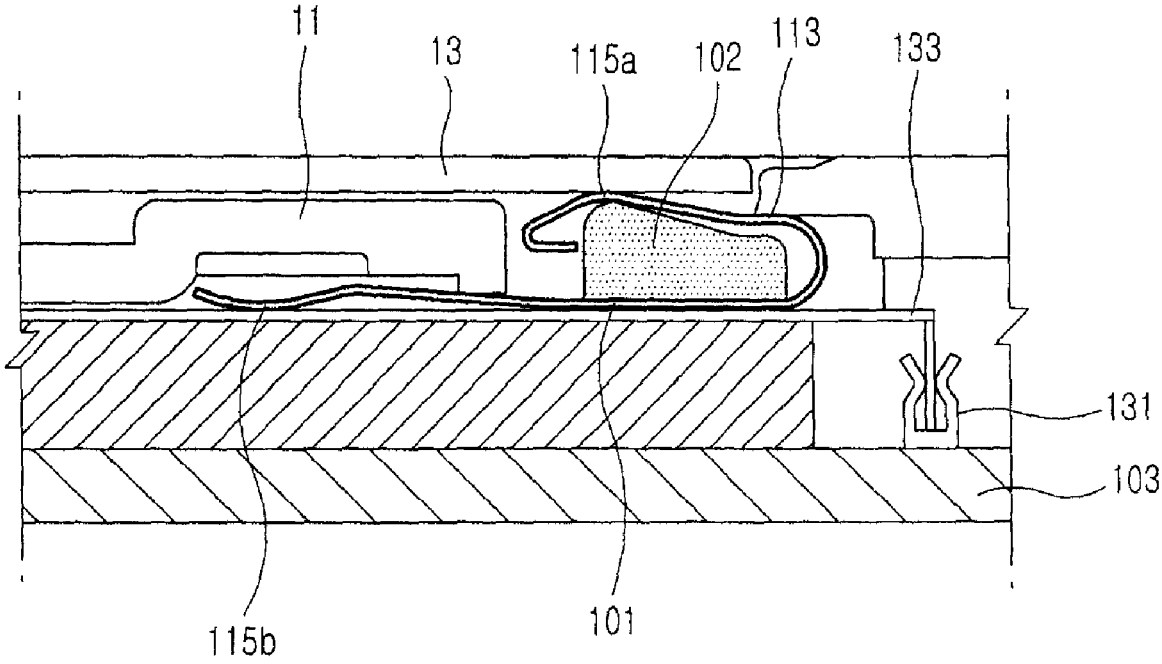
FIG.3 (PRIOR ART)
FIG. 3 is a configuration cross-sectional view illustrating the contact terminal as shown in FIG. 1.
Figure 4:
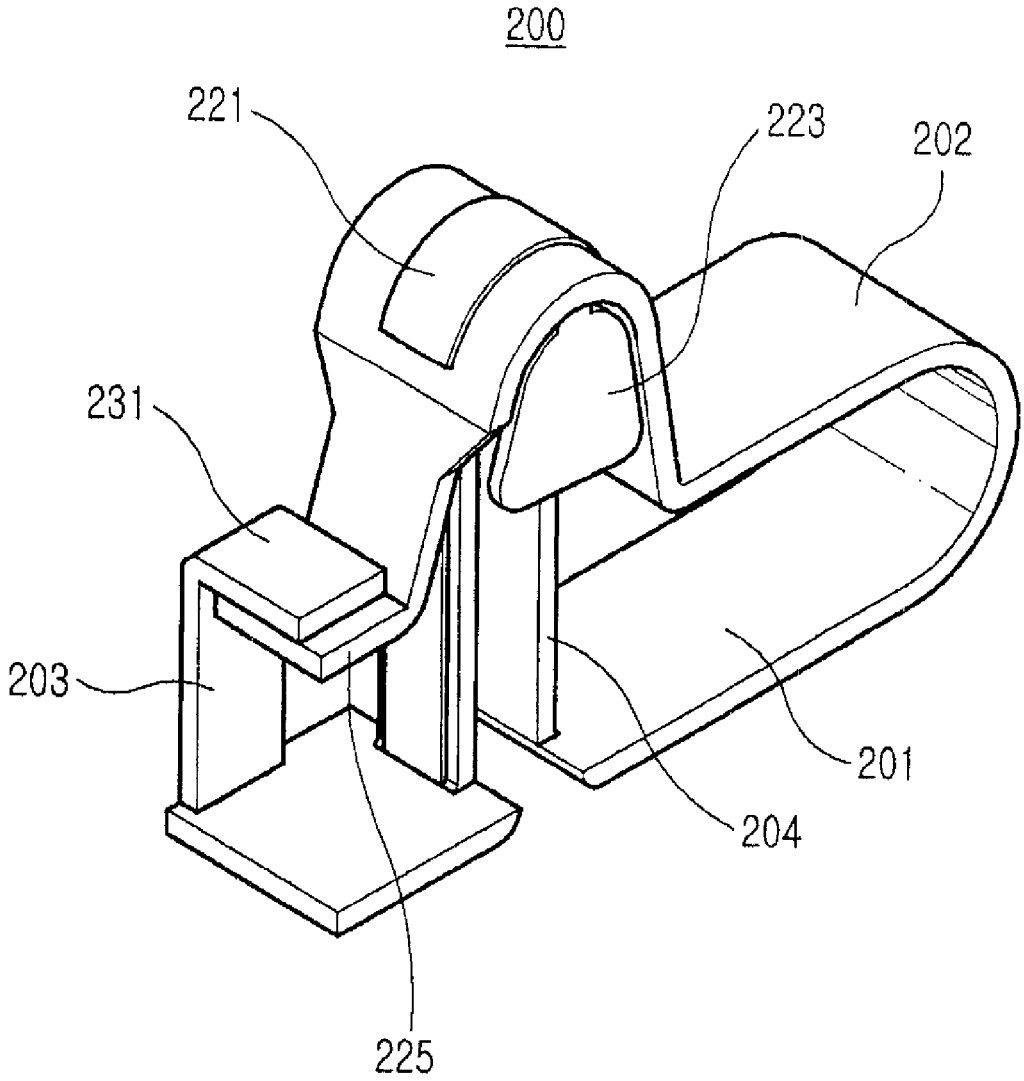
FIG. 4 is a perspective view illustrating a contact terminal of an electronic device, according to a preferred embodiment of the present invention.
Figure 5:
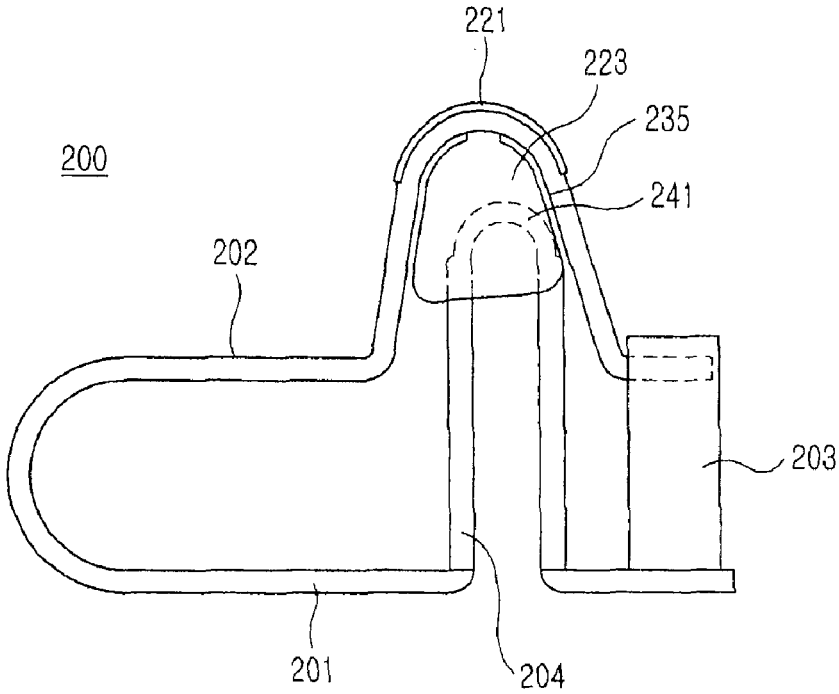
FIG. 5 is a side view illustrating the contact terminal as shown in FIG. 4.

Referring to FIGS. 4 and 5, a contact terminal 200 of an electronic device, according to an embodiment of the present invention, includes a fixing member 201, a contact member 202, and a limiting member 203, and may include a supporting member 204 for securing durability.

The contact terminal 200 is for the connection of a battery pack in the description of an embodiment of the present invention, but can be applied to other devices for connection between electronic devices, or between an electronic device and an additional device (such as a terminal for the connection of a SIM card, an interface connector for a cellular phone, a USB connector of a computer).

The contact terminal 200 may be fabricated by a cutting or casting (e.g. die casting) of a metallic plate, and can also be directly mounted on a circuit board through an SMD process because it does not include an additional supporting member made of urethane or silicon.

Figure 6:
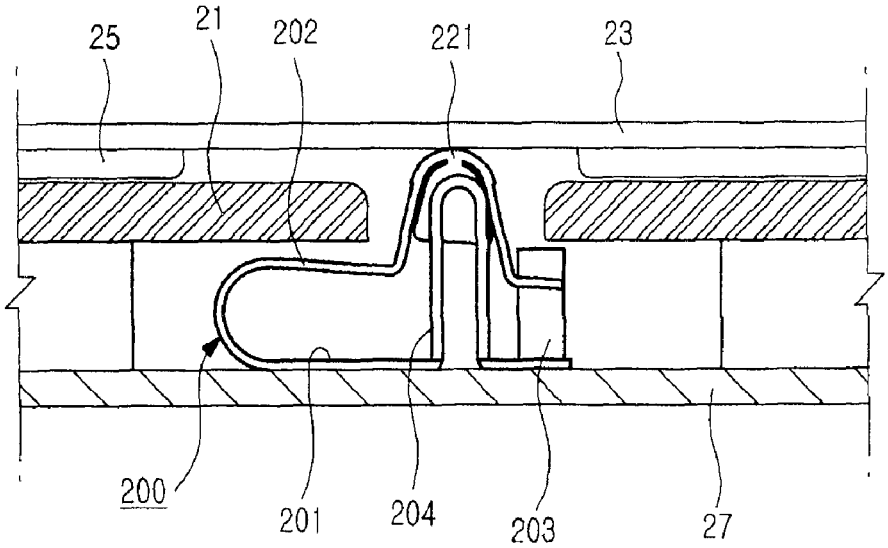
FIG. 6 is a configuration cross-sectional view illustrating the contact terminal as shown in FIG. 4.

The fixing member 201 supports other components of the contact terminal 200 while being fixed on a circuit board 27 within an electronic device case 21 (shown in FIG. 6). Further referring to FIG. 6, it can be seen that the fixing member 201 is fixed on the circuit board 27 disposed within the electronic device case 21. The fixing member 201 is fixed, for example, by an SMD process in which solder paste is applied on the circuit board 27, and then is hardened while the fixing member 201 is in close contact with the circuit board 27.

The contact member 202 extends from the fixing member 201, and is disposed to face the fixing member 201. The contact member 202 (FIGS. 4 and 5) includes a contact projection 221 whose part protrudes in a direction away from the fixing member 201. The contact terminal 200 provides an elastic force upon the contact member 202 in a direction away from the fixing member 201. Further referring to FIG. 6, a part of the contact terminal 200 is disposed within the case 21, and a part of the contact projection 221 protrudes to the outside of the case 21. When a battery pack 25, for example, is mounted in the electronic device, a power terminal 23 of the battery pack 25 contacts the contact projection 221 (FIG. 6). The contact projection 221 moves back into the electronic device to some extent, and the elastic force provided by the contact terminal 200 stably maintains the connection of the contact projection 221 with the power terminal 23.

From among both surfaces of the contact member 202, one facing the battery pack 25 is referred to as the 'outside surface', and the other facing the fixing member 201 is referred to the an 'inside surface'. Since the contact terminal 200 is formed by processing a metallic plate, on the inside surface of the contact member 202, specifically, the contact projection 221, an inclined plane 235 is formed.

The limiting member 203 extends from the fixing member 201 while its end portion 231 is bent to face the fixing member 201. The end portion of the limiting member 203 is disposed in such a manner that it can wrap the end portion of the contact member 202, which limits the range where the contact member 202 can move away from the fixing member 201. In other words, the contact terminal 200 provides an elastic force upon the contact member 202 in a direction away from the fixing member 201, while the limiting member 203 (element 231) limits the range that the contact member 202 can move way from the fixing member 201. Accordingly, if an external force is not operated, an elastic force of the contact terminal 200 itself maintains the contact member 202 in a state restrained by the end portion 231 of the limiting member 203.

As mentioned above, when the battery pack 25 is mounted in the electronic device case 21, the contact member 202 is moved back to the inside of the electronic device is maintained. If the contact member 202 is maintained inside of the electronic device for a long time, fatigue accumulation may permanently deform the contact terminal 200. In order to inhibit permanent deformation, the contact terminal 200 includes the supporting member 204. The supporting member 204 is disposed between the fixing member 201 and the contact member 202, and in the present embodiment, the supporting member 204 extends from the fixing member 201.

The supporting member 204 has a U shape, in which a couple of straight-line portions extend from the fixing member 201 and are connected to each other through a curved portion 241. The curved portion 241 of the supporting member 204 is disposed adjacent to the inside surface of the contact projection 221, and rubs against the inclined portion 235 of the inside surface of the contact member 202 when the contact member 202 moves back to the inside of the case 21. In the state where the battery pack 25 (FIG. 6) is mounted in the electronic device, the supporting member 204 limits the range that the contact projection 221 can come close to the inside of the electronic device i.e., to the fixing member 201, which stably maintains the connection of the contact projection 221 with the power terminal 23 of the battery pack 25. Also, in the state where the battery pack 25 is removed, the curved portion 241 of the supporting member 204 pushes up the contact projection 221 so that the contact projection 221 can protrude to the outside of the electronic device case 21.

Meanwhile, at both side ends of the contact projection 221, protecting members 223 are formed, respectively. The protecting members 223 are disposed in such a manner that they can wrap at least the curved part 241 of the supporting member 204. When the contact member 202 is moved back by mounting the battery pack 25, the supporting member 204 is subjected to an external force. For this reason, the protecting members 223 are provided in such a manner that they can wrap the supporting member, so as to prevent the supporting member 204 from being deformed.

Therefore, even when due to the mounting of an additional device, the contact member 202 comes closer to the fixing member 201 and thus adds an external force to the supporting member 204, it is possible to prevent the supporting member 204 from being deformed because of the wrapping of the protecting members 223.

The contact terminal for an electronic device, as described above, can reduce production costs, because it can be directly mounted on a circuit board by using a surface mounting device (SMD). Also, since the contact terminal is directly mounted on the circuit board without a connecting member or a socket, it is possible to improve the reliability of a product by reducing the interconnection loss between respective components. Furthermore, a limiting member and a supporting member limit the moving range of a connecting member, and thus prevent the excessive protrusion of the connecting member, and improve the durability of the product.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A contact terminal for an electronic device, the contact terminal comprising:

a fixing member;

a contact member extending from the fixing member, which moves while facing the fixing member; and a limiting member, which is bent and extends from the fixing member while an end portion of the limiting member restrains an end portion of the contact member, wherein the contact terminal provides an elastic force upon the contact member in a direction away from the fixing member, and a range where the contact member moves away from the fixing member is limited by the end portion of the limiting member restraining the end portion of the contact member; and wherein the contact terminal comprises a surface mount component in which the fixing member is configured for being directly mounted on a circuit board within the electronic device by surface mount technology via a surface mount device (SMD) process.

2. The contact terminal as claimed in claim 1, wherein the contact member further comprises a contact projection which protrudes and extends away from the fixing member.

3. The contact terminal as claimed in claim 2, further comprising a supporting member, which extends from the fixing member, and is disposed between the fixing member and the contact member, wherein the supporting member limits the contact member's range to the fixing member.

4. A contact terminal for an electronic device, the contact terminal comprising:

a fixing member:

a contact member extending from the fixing member, which moves while facing the fixing member;

a limiting member, which is bent and extends from the fixing member while an end portion of the limiting member restrains an end portion of the contact member, wherein the contact terminal provides an elastic force upon the contact member in a direction away from the fixing member, and a range where the contact member moves away from the fixing member is limited by the end portion of the limiting member restraining the end portion of the contact member, and wherein the contact member further comprises a contact projection which protrudes and extends away from the fixing member; and a supporting member, which extends from the fixing member, and is disposed between the fixing member and the contact member, wherein the supporting member limits the contact member's range to the fixing member, and wherein the supporting member has a 'U' shape, and a curved portion of the supporting member selectively rubs against one surface of the contact projection facing the fixing member.

5. The contact terminal as claimed in claim 4, wherein the contact member further comprises protecting members provided at both side ends of the contact projection, wherein the protecting members wrap at least one portion of the supporting member.

6. The contact terminal as claimed in claim 5, wherein the supporting member has a 'U' shape, and a curved portion of the supporting member selectively rubs against one surface of the contact projection facing the fixing member and is wrapped by the protecting members.

7. The contact terminal as claimed in claim 4, wherein the fixing member is mounted and fixed on a circuit board within the electronic device, and the contact projection protrudes to outside of the electronic device.

8. The contact terminal as claimed in claim 7, wherein when an additional device is mounted in the electronic device, the contact projection moves back into the electronic device by coming in contact with the additional device of the electronic device, and thus the contact member comes close to the fixing member.

9. The contact terminal as claimed in claim 8, further comprising a supporting member, which extends from the fixing member, and is disposed between the fixing member and the contact member, wherein when the contact member comes close to the fixing member, the supporting member rubs against the contact member, thereby limiting the contact member's range to the fixing member.

10. The contact terminal as claimed in claim 9, wherein the supporting member has a 'U' shape, and a curved portion of the supporting member selectively rubs against one surface of the contact projection facing the fixing member.

11. The contact terminal as claimed in claim 8, wherein the additional device is a battery pack of the electronic device, and the contact terminal comes in contact with a power terminal of the battery pack.

12. A terminal contact comprising:

a fixed element formed in an open loop, said fixed element having a first end and a second end;

a retaining element attached to said first end for retaining said second end;

a supporting member extending from a first surface of said fixed element between said first and second end; said supporting member limiting movement of a second surface of fixed member; and a U-shaped loop extending outward from a second surface of said fixed element opposite said first surface, said U-shaped loop positioned substantially to correspond to said supporting member.

13. The contact according to claim 12, wherein said supporting member comprises:

two arms extending from said first surface of said fixed element; and a curved surface joining said arms.

14. The contact according to claim 12, wherein said retaining member comprises:

a first arm extending from said first end of said fixed element; and a second arm extending substantially perpendicular from an unattached end of said first arm.

15. The contact according to claim 12, wherein said U-shaped loop is offset from said supporting member.

16. The contact according to claim 12, wherein said fixed element is composed of an electrically conductive material.

17. The contact according to claim 12 comprising a surface mount component in which the fixed clement is configured for being directly mounted on a circuit board within the electronic device via a surface mount device (SMD) process.

18. The contact terminal as claimed in claim 1, wherein the fixed element is directly mounted in a circuit board without a connecting member or socket.

19. The contact as claimed in claim 12, wherein the fixed element is directly mounted in a circuit board without a connecting member or socket.

* * * * *